United States Patent [19]

Howatt et al.

[11] 4,035,136

[45] July 12, 1977

[54] PIEZOELECTRIC IGNITION SYSTEM FOR GAS BURNERS

[75] Inventors: Glenn N. Howatt, Metuchen, N.J.; David J. Horvath, Aurora, Ohio

[73] Assignee: Vernitron Corporation, Great Neck, N.Y.

[21] Appl. No.: 612,378

[22] Filed: Sept. 11, 1975

[51] Int. Cl.[2] ..... F24C 3/10

[52] U.S. Cl. ..... 431/191; 431/263; 431/264

[58] Field of Search ..... 431/191, 192, 193, 194, 431/263, 264, 258; 317/81, 96

[56] References Cited

U.S. PATENT DOCUMENTS

| | | | |
|---|---|---|---|
| 2,073,966 | 3/1937 | Kahn | 431/191 X |
| 2,563,230 | 8/1951 | Fitzgerald | 431/191 X |
| 2,850,084 | 9/1958 | Kunzler | 431/263 |
| 3,523,747 | 8/1970 | Gross et al. | 431/192 |
| 3,529,910 | 9/1970 | Potts et al. | 317/96 X |
| 3,730,672 | 5/1973 | Berlincourt et al. | 431/264 |
| 3,758,264 | 9/1973 | Fidalkowski | 431/191 |

*Primary Examiner*—Edward G. Favors
*Attorney, Agent, or Firm*—Edward E. Sachs

[57] ABSTRACT

A piezoelectric ignition system for a plurality of gas burners includes an elongated adjustably mounted flash tube of high temperature resistant dielectric material mounted adjacent each burner. A pair of electrodes are mounted on each flash tube in spaced-apart relationship to define spark gaps, and are electrically connected in series with one another across opposite sides of a single piezoelectric voltage source. The system is adapted to accommodate heavier and lighter than air combustible gases.

16 Claims, 7 Drawing Figures

PIEZOELECTRIC IGNITION SYSTEM FOR GAS BURNERS

The invention relates generally to piezoelectric ignition systems for gas burners and, more particularly, to piezoelectric ignition systems for a plurality of gas burners.

Most prior piezoelectric ignition systems are capable of igniting only two independent burners with a single voltage source. In one such arrangement, the high voltage source has two leads, with one lead being connected to one side of one spark gap and the other lead connected to one side of the other spark gap. The other side of each spark gap is usually defined by the burner or a metal flash tube connected to the appliance ground. With the other side of each spark gap being grounded, it is not possible to ignite more than two burners with one high voltage source unless the spark gaps are connected in parallel. However, connecting multiple spark gaps in parallel is not reliable because one spark gap will typically break down before those in parallel with it, and subsequent applications of high voltage will be inadequate to provide a spark across the other gaps. Examples of ignition systems of this general type include those disclosed in U.S. Pat. Nos. 3,461,853 issued Aug. 19, 1969, to Riehl; 3,490,425 issued Jan. 20, 1970, to Rice; and 3,511,588 issued May 12, 1970, to Wolfe et al.

One suggested arrangement for connecting more than two burners for ignition by a single high voltage source is disclosed in U.S. Pat. No. 3,730,672 issued May 1, 1973, to Berlincourt. In this arrangement, the spark gaps are located within the burners but below the flame in an attempt to prevent ionized gas particles from shorting out the spark gaps. However, after one burner has been on for a time, ionized gas particles may collect within the burner in the area of the spark gap, and the heat in the lower portion of the burner itself may cause ionization of air and short out the spark gap in that burner so that ignition of adjacent burners is not possible. In addition, one final spark gap in Berlincourt is between an electrode and a burner. If the final burner is ignited first, subsequent ignition of the other burners may not be possible because use of the final burner as one electrode may short out its spark gap. Although the other electrodes are insulated from the burners, connection of the one final burner to one side of the high voltage source also effectively connects the other burners to the appliance ground. This can result in sparking of the electrodes to the burners instead of across the electrode gap and may prevent sparking across the other gaps.

The problem with most prior piezoelectric ignition systems, including that of Berlincourt, has been that ionization shorts out the series spark gaps when such gaps are located too close to the burner ports. Positioning the spark gaps far enough from the burner ports to prevent shorting out due to ionization often results in erratic ignition or no ignition at all. Moreover, most, if not all, conventional systems cannot be adapted for heavier as well as lighter than air gases and are usually limited to one such category.

It is therefore the primary object of the present invention to provide a piezoelectric ignition system which is capable of reliably igniting more than two burners with a single high voltage source for a variety of common combustible gases.

It is a further object of the invention to provide an improved piezoelectric ignition system for a plurality of gas burners by the use of improved flash tubes.

It is an additional object of the invention to provide an improved flash tube for use with piezoelectric ignition systems for gas burners.

It is also an object of the invention to provide an improved piezoelectric ignition system for gas burners wherein all of the spark gaps are across electrodes connected in series with one another across opposite sides of a high voltage source and being electrically isolated from the burners or flash tubes.

It is a further object of the present invention to provide an ignition system for gas burners of the type referred to above in which the position of the flash tube relative to the gas stream is adjustable to accommodate gases heavier as well as those lighter than air.

An aspect of the present invention resides in an elongated flash tube made in one piece of high temperature resistant dielectric material having integral mounting means thereon for mounting same adjacent a burner and also for mounting a pair of electrodes thereto to define a spark gap. The electrodes defining the spark gap adjacent each burner are remotely positioned outwardly of the burners to prevent shorting of the spark gaps by ionization. All of the spark gaps are electrically isolated from the burners and flash tubes for insuring generation of sparks across all of the spark gaps, and the electrodes for all of the spark gaps are electrically connected in series with one another across opposite sides of the piezoelectric voltage source.

In one arrangement, the one-piece flash tube has integral mounting means thereon defined by a generally radially extending flange having a plurality of spaced-apart fastener receiving apertures therein. The flange preferably extends substantially less than 360° around the flash tube. The flash tube has an open front end located adjacent burner port means and an open rear end positioned lower than the front end thereof so that combustible fuel gas flows through the flash tube to the spark gap located adjacent the rear end of the flash tube.

For a better understanding of the present invention, together with other and further objects thereof, reference is had to the following description taken in connection with the accompanying drawings, and its scope will be pointed out in the appended claims.

Figure 1:
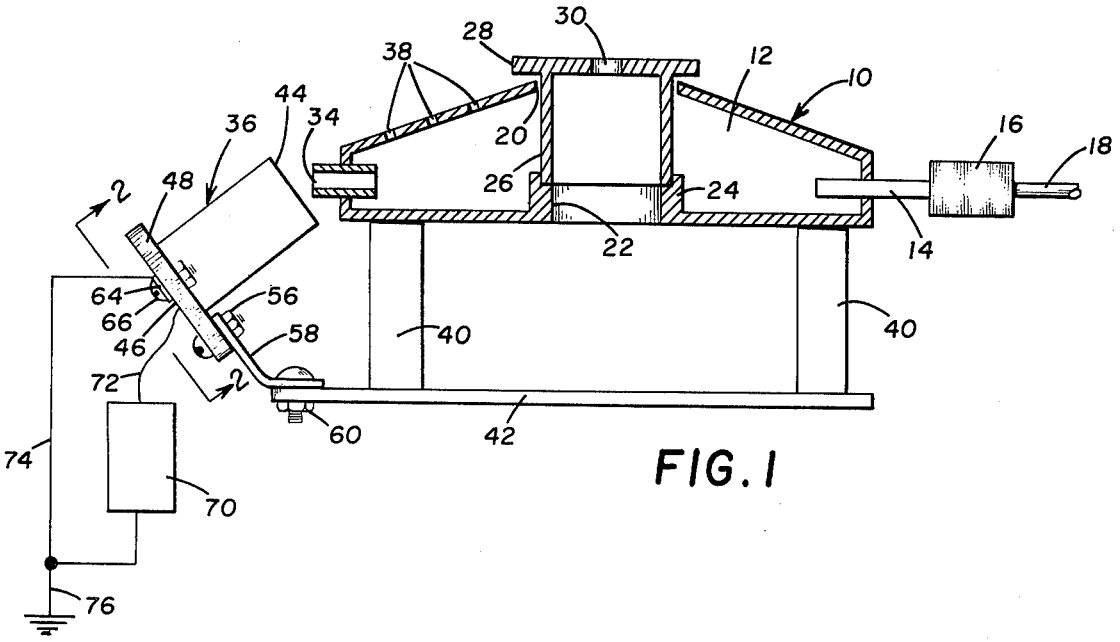
FIG. 1 is a somewhat diagrammatic cross-sectional elevational view of a gas burner having the improved ignition system of the present invention associated therewith.
Figure 2:
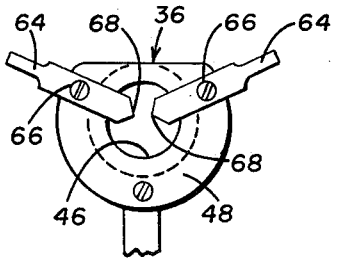
FIG. 2 is an end elevational view looking generally in the direction of arrows 2—2 of FIG. 1.
Figure 3:
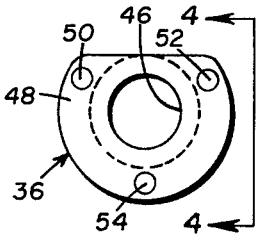
FIG. 3 is an end elevational view similar to FIG. 2 and showing an improved flash tube without the electrodes attached thereto.
Figure 4:
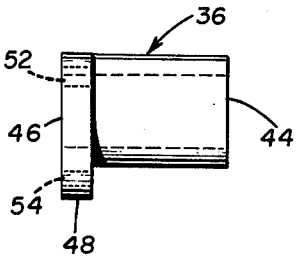
FIG. 4 is a side elevational view looking generally in the direction of arrows 4—4 of FIG. 3.

Referring now the drawing, and particularly FIG. 1, there is shown a gas burner 10 which may take many forms and the one particularly shown is simply by way of illustration. The burner 10 has an internal chamber 12 supplied with combustible fuel gas through conduit 14 and control valve 16 from a supply manifold 18. The fuel gas may be of any type, including butane, propane or natural gas.

A circular top opening 20 in the burner 10 is aligned with a circular bottom opening 22 surrounded by a circular upstanding support 24 for a cylindrical member 26 having a diameter slightly less than the top opening 20, and having an outwardly extending upper flange 28 spaced above the top opening 20. Suitable apertures as at 30 are provided in the top of the cylindrical member 26 for flow of air upwardly therethrough and through the bottom opening 22. The circumferential space between the top opening 20, and the peripheral wall of the cylindrical member 26 and the top flange 28, defines burner port means through which combustible fuel gas flows from the chamber 12. Also defining part of the burner port means is a small side ignition port 34 which supplies combustible fuel gas to a flash tube 36. Very small and spaced openings as at 38 are provided in the burner 10 so that when ignition occurs at the port 34, the flame walks up the burner by igniting the fuel flowing through the small ports 38 to ignite the fuel at the main burner port between the top opening 20 and the cylindrical member 26. The burner 10 has suitable mounts as at 40 for mounting same to a support 42.

The flash tube 36 is mounted adjacent the burner 10 and outwardly therefrom for igniting the burner 10. The flash tube 36 is a one-piece elongated hollow member made of high temperature resistant electrical insulating material. The flash tube 36 is preferably made of a ceramic material of any suitable type such as pressed steatite, although other high temperature resistant materials, including magnesia, clay, alumina, cordierite and glass frit, or a combination thereof, can be used. The flash tube 36 has an open front end 44 and an open rear end 46 at opposite ends of a cylindrical bore therethrough.

The flash tube 36 has integral mounting means in the form of a generally radially outwardly extending flange 48 adjacent the rear end 46 for mounting the flash tube 36 to a support and for mounting electrodes thereto. The mounting flange 48 preferably extends slightly greater than 180° around the flash tube 36 and substantially less than 360° therearound for saving material and lowering the profile of the flash tube. The flange 48 has a plurality of circumferentially-spaced fastener receiving apertures 50, 52 and 54 therethrough. A nut and screw fastener assembly 56 extends through aperture 54, and through another suitable aperture in mounting bracket 58 secured to the support 42 by another nut and screw fastener assembly 60. The flash tube 36 is preferably mounted with the open front end 44 thereof at a higher elevation than the open rear end 46 so that the heavier than air combustible fuel gas flowing through the port 34 aligned with the open front end 44 will flow under the influence of gravity from the front end 44 toward the rear end 46. In one arrangement, the longitudinal axis of the flash tube 36 is mounted at an angle of approximately 30° to the horizontal and the electrodes are located below the burner ports as well as below the front end 44 of the flash tube 36.

A pair of flat metal electrodes 64 are secured to the flange 48 by nut and screw fastener assemblies 66 extending through suitable holes in such electrodes 64, and through apertures 50 and 52. The electrodes 64 have sharp tips 68 spaced apart from one another at the open rear end 46, and generally aligned with the longitudinal axis of tube 36, to define a spark gap.

An electro-mechanical transducer 70 is provided for generating a spark across the spark gap between electrodes 64 and is preferably in the form of a piezoelectric high voltage source of any suitable type, including those disclosed in U.S. Pat. Nos. 3,449,637 issued June 10, 1969, to Suzuki and 3,469,119 issued Sept. 23, 1969, to Parkinson. A hot lead 72 connected to one side of high voltage source 70 is connected to one electrode 64, while the other electrode 64 is connected to a lead 74 connected with the other side of the high voltage source 70 which may also be connected to ground as at 76.

Figure 5:
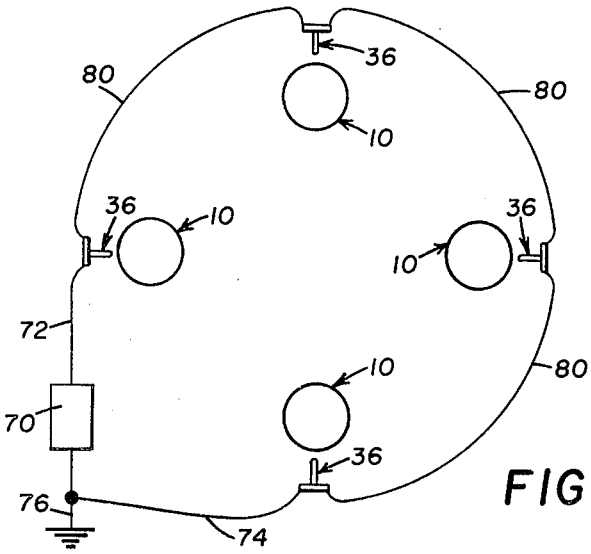
FIG. 5 is a diagrammatic illustration showing more than two burners connected with the improved piezoelectric ignition system of the present invention.

FIG. 5 diagrammatically shows four burners 10 each having a flash tube 36 associated therewith in the same manner as described with respect to FIG. 1. The electrodes on all four of the plurality of flash tubes 36 are electrically connected in series with one another across spark gaps and directly across opposite sides of high voltage source 70. Wires as at 80 span one electrode of each pair on adjacent flash tubes 36 so that all of the spark gaps are electrically connected in series with one another across opposite sides of the high voltage source 70.

Positioning of the electrodes remote from the burners 10 prevents shorting of the spark gaps due to ionization of the air after ignition. All of the electrodes are electrically isolated from the burners 10 and the burner ports, along with the flash tubes, so that the sparks are generated directly across two electrodes connected to opposite sides of the voltage source 70, instead of across one electrode connected with a voltage source and a burner or metal flash tube connected wtih ground.

When the valve 16 is turned on for any one of the burners 10, combustible fuel flows to the corresponding burner and gravitates from port 34 to the rear end 46 of the flash tube 36. Operation of the high voltage source will generate a spark across the spark gaps between the pair of electrodes 64 associated with each burner to ignite the fuel for the burners whose fuel valves have been turned on. With one or more of the burners 10 in FIG. 5 ignited, subsequent operation of the high voltage source 70 will still generate a spark across the spark gap for each flash tube 36 associated with each burner 10 so that subsequent burners can be ignited when their supply valves are turned on.

Once a burner 10 is ignited, the flame from the small port 34 is very small and rises so it does not enter the flash tube 36. This insures sparking across all of the spark gaps for subsequent ignition of the other burners when their fuel supply valves are turned on. Although the arrangement shown directly ignites a main burner, it will be recognized that pilot burners can be ignited instead. In addition, the arrangement of this application can be used to directly ignite a main burner port instead of a small ignition port. Use of a pair of electrodes to form the spark gap instead of using a burner or metal flash tube connected to ground for the other electrode enables connection of more than two spark gaps to single high voltage source. Positioning the spark gaps outwardly remote from the burners and conducting fuel to the gaps through flash tubes prevents shorting of any spark gap due to ionization. When ignition occurs within a flash tube, the flame shoots outwardly therefrom to ignite the main burner. Thereafter, the flame and combustion products rise so that the electrodes remain cool and out of the area of ionized particles. Once a burner is ignited, ambient air is drawn through the flash tube past the electrodes toward the burner for maintaining the electrodes cool and insuring that ionized particles will not collect in the area of the spark gap. This is particularly advantageous where the electrodes, and their spark gaps, are located below the burner ports as in the present application.

A further, but very significant, embodiment of this invention permits the flash tube 36 and the electrodes 64 to be positioned, or adjusted, to the location required to compensate for gas flow conditions due to the density or specific gravity of various combustible gases. Thus, for instance, for a gas such as methane, which has a density of 0.7168 (g/l,0° C, 760 mm) and is lighter than air, it is desirable to angularly align tube 36 relative to port 34 so that the gases moving in an upward direction will still flow from the port 34 into the flash tube. For this purpose, the central axis of the flash tube will extend upwardly, i.e., will assume a position that is substantially opposite to that illustrated in FIG. 1. The lighter than air gases will have the tendency to hug the upper region of the flash tube and the electrodes can be aligned accordingly by manipulation of electrodes 64 and screws 66. The converse situation and arrangement takes place for heavier than air gases.

Figure 6:
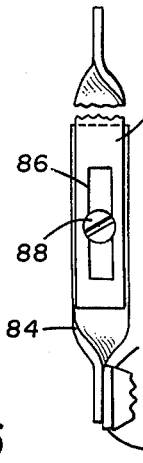
FIGS. 6 and 6*a* are an elevational view and a side view, respectively, of an adjustable mounting bracket for the flash tube.
Figure 6A:
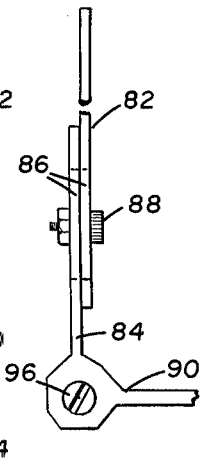

For many commonly used gases simply bending bracket 58 will suffice to accomplish the required positioning of flash tube 36 referred to in the preceding paragraph. However, it is also possible to use a bracket 58 which specifically provides for angular and lengthwise adjustment. Referring now to FIGS. 6 and **6*a* there is shown a bracket 58' comprising two elongated bars 82, 84 each provided with longitudinally extending slots 86 with an adjusting screw 88 extending therethrough securing the bars together in a lengthwise adjustable relationship. At one, or optionally, at both longitudinal ends of bars 82, 84 the generally flat bars are helically twisted to provide a right angle mating surface for bar 90. The mating surfaces, see 92 and 94, are held together and angularly adjustable by means of screw connection 96. With the modified bracket 58' practically any required position of the flash tube 36 vis-a-vis the port 34** can be achieved.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications which fall within the true spirit and scope of the invention.

What is claimed is:

1. A spark ignition system for gas burners comprising: gas burner means for burning combustible fuel gas and having burner port means for flow of fuel gas therethrough, an elongated flash tube means having front and rear ends and being mounted with said front end thereof positioned adjacent said port means for flow of uncombusted fuel gas through said tube from said front end to said rear end thereof, said tube being mounted with said rear end thereof laterally spaced from said burner means to be out of contact with the flame from said burner means after said fuel gas is combusted, said tube being made of high temperature resistant dielectric material, a pair of electrodes mounted directly to said tube and having electrode ends spaced apart at said rear end to define a spark gap, and selectively operable voltage means for applying an electrical potential difference across said electrodes to generate a spark across said gap.

2. A spark ignition system according to claim 1, wherein said tube has integral mounting means thereon adjacent said rear end for mounting said tube adjacent said burner means and for mounting said electrodes to said tube.

3. A spark ignition system according to claim 2, wherein said mounting means comprises a generally radially extending flange having a plurality of sppaced-apart fastener receiving apertures therein, and fasteners extending through said apertures for mounting said tube adjacent said burner means and securing said electrodes to said tube.

4. A spark ignition system according to claim 3, wherein said flange extends substantially less than 360° around said tube.

5. A spark ignition system according to claim 1, wherein said combustible fuel gas is heavier than air and said tube is mounted with said rear end thereof lower than said front end thereof for gravitational flow of uncombusted fuel gas through said tube.

6. A spark ignition system according to claim 1, wherein said combustible fuel gas is lighter than air and said tube is mounted with said rear end thereof higher than said front end thereof for gravitational flow of uncombusted fuel gas through said tube.

7. A spark ignition system according to claim 1, wherein said burner means comprises a plurality of individual burners each having one of said tubes mounted adjacent thereto, said voltage means comprising a single piezoelectric voltage source, and said electrodes on said tubes being connected in series with opposite sides of said piezoelectric voltage source.

8. A spark ignition system according to claim 1, wherein said voltage means comprises a piezoelectric voltage source.

9. A spark ignition system according to claim 1, and bracket means connecting to said tube for mounting said tube in operating position relative to said port means, said bracket means including adjusting means for adjustably positioning said flash tube to selectively vary the inclination and elevation of said flash tube relative to said burner port means.

10. A spark ignition system according to claim 1, and adjustable bracket means connecting to said tube for adjustably mounting said tube in operating position relative to said port means, said bracket means having a plurality of structural members angularly adjustable relative to each other for selectively varying the inclination of said tube relative to said port means.

11. A spark ignition system according to claim 10, wherein said structural members are also adjustable lengthwise to each other for selectively varying the elevation of said tube relative to said port means.

12. A piezoelectric ignition system for a plurality of individual gas burners comprising: a pair of electrodes mounted adjacent each said burner and outwardly thereof to define a spark gap adjacent each said burner, each said pair of electrodes being mounted on electrical insulating material and being electrically isolated from said burners, a single piezoelectric voltage source, said electrodes being electrically connected in series with one another across opposite sides of said voltage source so that operation of said voltage source generates a spark across all of said spark gaps, a flash tube positioned between each said burner and each said spark gap, and each said pair of electrodes being electrically isolated from said flash tubes.

13. A spark ignition system according to claim 12 wherein each said flash tube comprises a one-piece elongated flash tube made of high temperature resistant dielectric material.

14. A spark ignition system for gas burners comprising: gas burner means for burning combustible fuel gas and having burner port means for flow of fuel gas therethrough, an elongated hollow flash tube having open front and rear ends, said flash tube being mounted with said front end thereof positioned adjacent said burner port means for flow of uncombusted fuel gas through said flash tube from said front end to said rear end thereof and with said rear end laterally spaced from said burner means to be out of contact with the flame from said burner means after said fuel gas is combusted, a pair of electrodes having electrode ends spaced apart to define a spark gap and being mounted with said gap located adjacent said open rear end of said flash tube, selectively operable voltage means for applying an electrical potential difference across said electrodes to generate a spark across said gap, common mounting means for so mounting said flash tube and said pair of electrodes to a support adjacent said burner with said electrodes being electrically isolated from said tube, burner and support, said common mounting means including a mounting member of high temperature resistant dielectric material attached to said flash tube adjacent said rear end thereof, said electrodes being secured to said mounting member, and a bracket secured between said mounting member and said support.

15. The ignition system of claim 14 wherein said flash tube is made of high temperature resistant dielectric material and said mounting member comprises an outwardly extending flange on said flash tube adjacent said rear end thereof.

16. A spark ignition system for gas burners comprising: gas burner means for burning combustible fuel gas and having burner port means for flow of fuel gas therethrough, an elongated hollow flash tube having open front and rear ends, said flash tube being mounted with said front end thereof positioned adjacent said burner port means for flow of uncombusted fuel gas through said flash tube from said front end to said rear end thereof and with said rear end laterally spaced from said burner means to be out of contact with the flame from said burner means after said fuel gas is combusted, a pair of electrodes having electrode ends spaced apart to define a spark gap and being mounted with said gap located adjacent said open rear end of said flash tube, selectively operable voltage means for applying an electrical potential difference across said electrodes to generate a spark across said gap, common mounting means for so mounting said flash tube and said pair of electrodes to a support adjacent said burner with said electrodes being electrically isolated from said tube, burner and support, and said common mounting means including adjusting means for adjustably varying the inclination and elevation of said flash tube relative to said burner port means while maintaining the relative position of said spark gap with respect to said flash tube.

* * * * *